US006594960B2

(12) United States Patent
Brittain et al.

(10) Patent No.: US 6,594,960 B2
(45) Date of Patent: Jul. 22, 2003

(54) METHOD OF FOLDING AN ARTICULATING MAST

(75) Inventors: John Brittain, Tulsa, OK (US); Dewayne Vogt, Tulsa, OK (US)

(73) Assignee: Woolslayer Companies, Inc., Tulsa, OK (US)

( * ) Notice: Subject to any disclaimer, the term of this patent is extended or adjusted under 35 U.S.C. 154(b) by 0 days.

(21) Appl. No.: 09/954,906

(22) Filed: Sep. 18, 2001

(65) Prior Publication Data

US 2003/0051915 A1 Mar. 20, 2003

(51) Int. Cl.[7] ..... B66C 23/60; E21B 15/00

(52) U.S. Cl. ..... 52/117; 52/123.1; 52/745.18; 175/202

(58) Field of Search ..... 175/57, 202, 203, 175/424; 52/112, 116, 117, 119, 120, 123.1, 125.2, 125.6, 745.17, 127.5, 127.7, 745.18; 16/224, 235; 414/10

(56) References Cited

U.S. PATENT DOCUMENTS 1,561,724 A * 11/1925 Keltner ..... 52/116
2,354,922 A * 9/1944 McEwen et al. ..... 52/119
2,711,804 A * 6/1955 Woolslayer et al. ..... 52/120
3,483,933 A * 12/1969 Dyer et al. ..... 52/125.2
3,498,375 A 3/1970 McEwen et al. ..... 166/79
3,718,266 A 2/1973 Donnally ..... 414/22.71
3,942,593 A * 3/1976 Reeve et al. ..... 52/118
4,651,884 A * 3/1987 Kennard, Jr. et al. ..... 52/120
5,038,871 A 8/1991 Dinsdale ..... 175/52
5,211,251 A 5/1993 Woolslayer ..... 175/85
6,430,887 B1 * 8/2002 Daudet ..... 16/224

FOREIGN PATENT DOCUMENTS

GB 717099 * 10/1954 ..... 52/120

* cited by examiner

*Primary Examiner*—David Bagnell
*Assistant Examiner*—Matthew Smith
(74) *Attorney, Agent, or Firm*—Head, Johnson & Kachigian

(57) ABSTRACT

An articulating derrick having a back face, a pair of opposed sides with each side having at least one leg, and an open face. The back face of the derrick includes a plurality of pairs of back face cross supports. Each cross support has a first and a second opposed end. Each first end is pivotally attached to one of the legs. A bushing pivotally connects the second ends of each pair of cross supports in order to permit movement of the back face between a folded, storage position and an open position.

13 Claims, 8 Drawing Sheets

METHOD OF FOLDING AN ARTICULATING MAST

BACKGROUND OF THE INVENTION

1. Field of the Invention

The present invention relates to an articulating or folding mast that may be transported from one well drilling site to another. In particular, the present invention relates to a folding mast wherein sections of the mast may be moved from an open, in-use position to a folded position for storage and transportation and then moved from the folded position to an open position for use.

2. Prior Art

In oil and gas operations, well drilling rigs are utilized to drill for reserves. Many times drilling does not result in a productive well and it has been estimated that over two million boreholes have been dug world wide.

A mast or derrick of a drilling rig supports a vertically moving block and tackle in order to raise and lower drill pipes. Masts or derricks are well known for use in oil and gas and other drilling operations. A mast often extends up to 200 feet and is often composed of structural steel framework which supports a crown assembly. The crown assembly is an arrangement of sheaves at the top of the mast or derrick directly above the well bore.

Various drilling structure arrangements are known although one arrangement includes a pair of sides with a back face joining the sides and an open front face. A mast is typically braced on three sides with an open front face to receive pipe sections.

As drilling is conducted, the drill bit becomes dull and the whole drill string has to be taken out of the hole and the bit replaced. In addition, casing, consisting of thick-walled pipes are screwed together and lowered into the well.

From time to time, once a drilling project has been completed, it is required to move the drilling rig from one location to another location. In one known arrangement, the entire drilling rig is disassembled piece by piece, then transported to the next location, and then reassembled.

As a technological advance on the complete disassembly and reassembly of the mast, a folding gin pole arrangement was developed. The entire mast could be moved from vertical to a horizontal position by a wire line extending from the crown to a gin pole at the base. Once on the ground, the mast could be disassembled. Normally, the mast sections are transported by trailer. Disassembly of the sections is normally required due to roadway limits as to height and width.

The mast may be divided into sections and the sections of the mast moved to a new location. Accordingly, it would be desirable to be able to fit the various mast sections onto trailers.

Additionally, it would be advantageous for the mast sections to be able to meet roadway requirements for size of load. For example, certain highway regulations limit the width of the load to twelve feet. Accordingly, it would be advantageous to provide a mast wherein sections may be folded to a width acceptable for roadway requirements.

It would also be advantageous to provide a mast having sections that may be moved between an open, in-use position and a folded position for storage and transportation.

It would also be advantageous to provide a mast having sections that may be locked in either an open, in-use position or a folded position.

It would also be advantageous to provide an articulating mast wherein the required disassembly and subsequent re-assembly is reduced.

SUMMARY OF THE INVENTION

The present invention provides an articulating mast which will be used in connection with well drilling. In position for use, the mast will be aligned vertically to the ground over a well bore.

In a preferred embodiment, the mast may include a sub base, a bottom section, a lower intermediate section, an upper intermediate section, a top section and a crown assembly section. Each of the adjoining sections may be pinned together to form the mast. In a preferred embodiment, the mast will include a pair of opposed sides and it will also include a back face connecting the sides together. The front face will generally be open but may include a tubing support assembly and a racking platform assembly. The open front face permits the entry and removal of tubing sections in connection with the drilling operation.

In a preferred embodiment, the mast will include four legs which will be pyramidal in structure with the widest cross section at the sub base and thereafter tapering towards the more narrow portion at the crown assembly.

The back face includes a plurality of pairs of back face cross supports. Each pair of back face cross supports spans the back face and connects with the opposed sides and, in particular, connects to the legs of the sides.

Additionally, the back face includes a plurality of angled braces which extend between the cross supports and the legs of the sides.

Each pair of cross supports is joined together to span the back face. Each individual cross support has a first and a second opposed end. Each of the second ends are pivotally connected to each other through a bushing. The bushing may be a misaligning bushing having a ball inside of a race.

Each first end of the cross support is pivotally connected to one of the legs. Each first end will be permitted to rotate through an axis about a hinge pin. Each first end terminates in an extending ear having an aperture therethrough. As the first end rotates, the extending ear moves between a storage position and an open position. The aperture will align with an opening in the open position and will align with an opening in the storage position.

Each of the angles braces will be pivotally connected with a leg. Each angled brace will articulate with respect to the leg and rotate about a pivot.

In order to unfold the mast section and move the section to the open position, a lifting beam and a spreader bar or bars may be utilized. The spreader bar will be attached between the cross supports near the bushing. The spreader bar in turn will be connected to the lifting beam. The lifting beam may be attached by an eye or otherwise to a wire line and a lifting mechanism such as a crane or tractor. The lifting beam and spreader bars may be detached from the mast section once the section is in the fully opened position.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
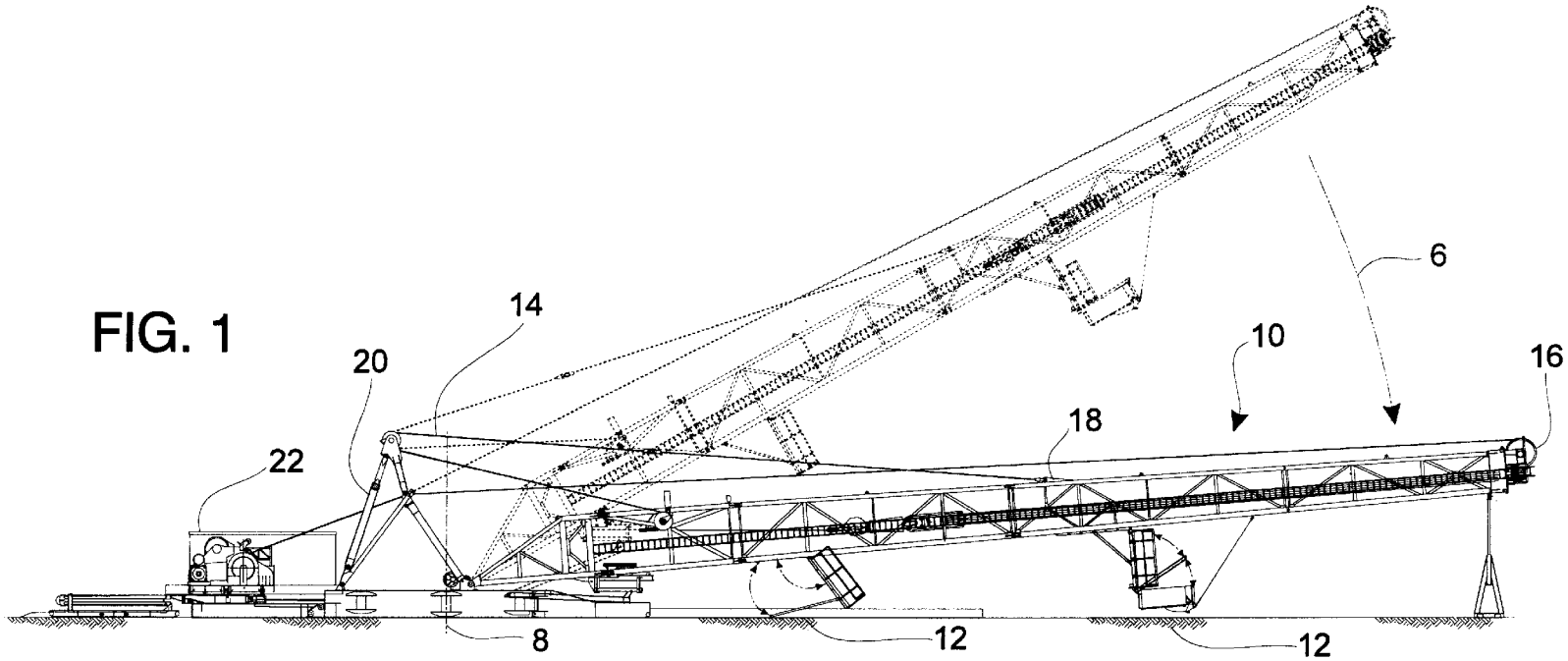
FIGS. 1 and 2 illustrate movement of a mast from a vertical, in-use position to a horizontal position.
Figure 2:
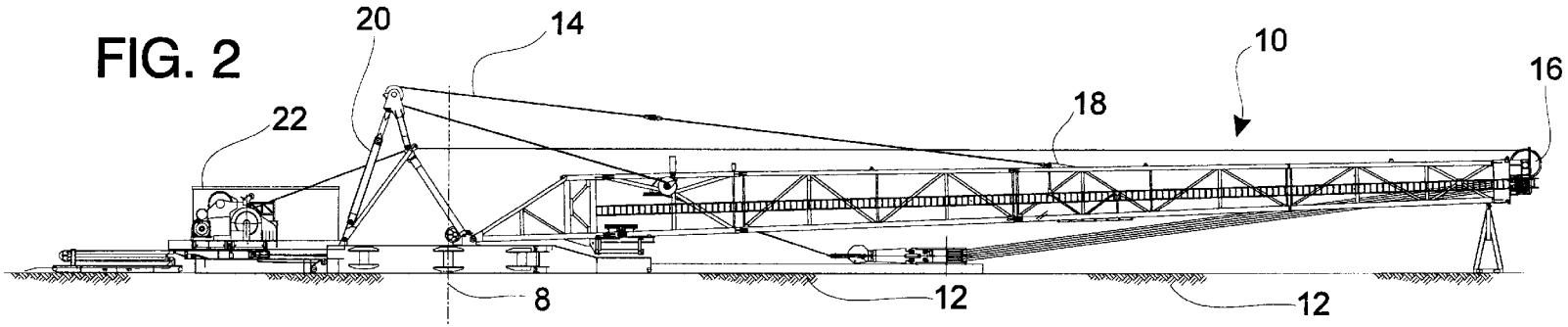

Referring to the drawings in detail, FIGS. 1 and 2 illustrate the movement of a mast 10 moving from a vertical to a horizontal position. In position for use, the mast will be aligned vertically (not seen in FIG. 1) to the ground 12 over a wellbore (illustrated by dashed line 8). In FIG. 1, the mast 10 is shown traveling toward the horizontal position as illustrated by arrow 6. In FIG. 2, the mast 10 is in the horizontal position at rest on the ground 12. The mast 10 is lowered from the vertical position by use of a sling line 14 which is reeved over a number of sheaves and fastened at two places along the mast 10, at the top 16 and at a midway point 18. A folding gin pole 20 and a draw works 22 assist in lowering the mast. Once the mast is in the horizontal position, various sections comprising the mast may be disassembled for transportation to another location.

The reverse operation is performed to raise the mast to the vertical position. The various sections are brought together and connected. The folding gin pole 20 and draw works 22 are used 20 to raise the mast 10. It will be understood that the foregoing description of the raising and lowering of the mast is known and does not comprise the present invention but is provided as background for an understanding of the invention.

Figure 3:
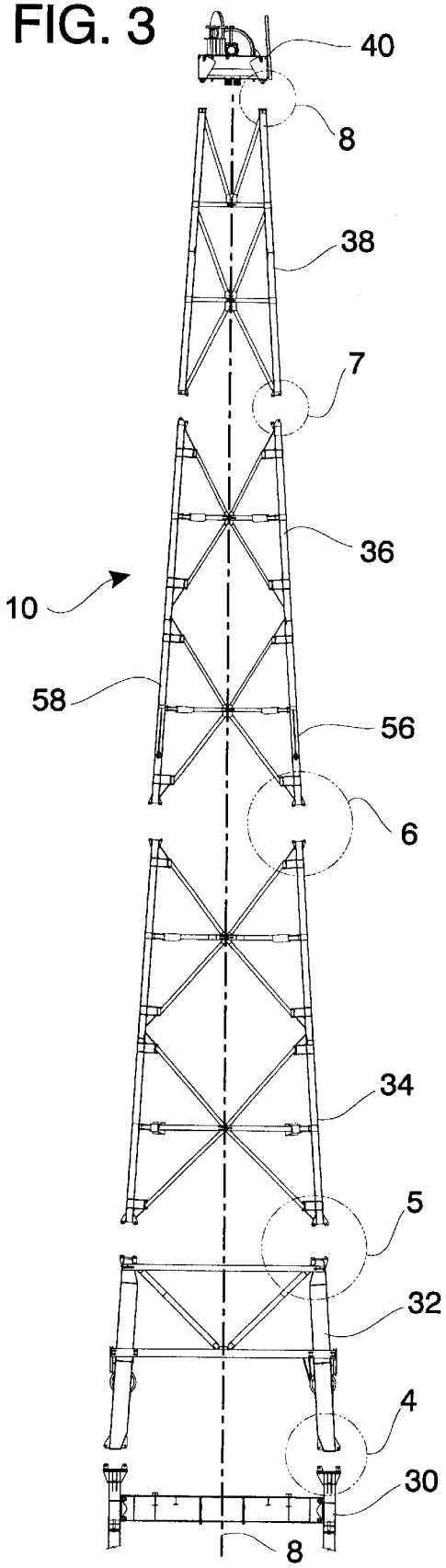
FIG. 3 is an exploded view of a mast showing its various sections.
Figure 8:
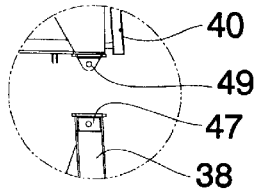
FIGS. 4, 5, 6, 7 and 8 are enlarged views illustrating the connections between the various mast sections shown in FIG. 3.

FIG. 3 shows a back view of a mast 10 with the sections of the mast 10 in exploded view apart from the rest of the drilling rig. In one preferred embodiment shown, the mast 10 will include a sub base 30, a bottom section 32, a lower intermediate section 34, an upper intermediate section 36, a top section 38 and a crown assembly section 40.

Figure 4:
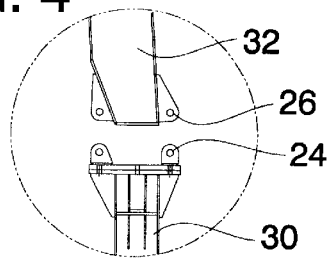

FIG. 4 shows an enlarged view of the connection between the sub base 30 and the bottom section 32. Openings 24 through the sub base align with openings 26 through the bottom section so these sections may be brought and pinned together.

Figure 5:
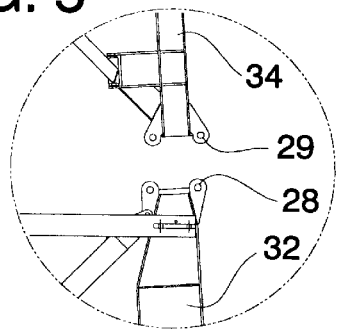

FIG. 5 illustrates an enlarged view of the connection between the bottom section 32 and the lower intermediate section 34. Openings 28 through the bottom section 32 align with openings 29 through the lower intermediate section 34 so these sections may be brought and pinned together.

Figure 6:
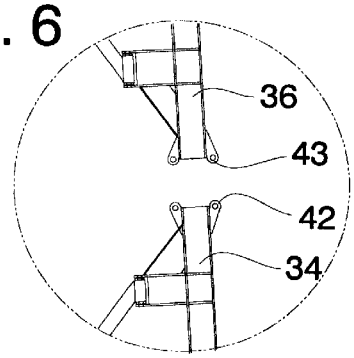

FIG. 6 illustrates an enlarged view of the connection between the lower intermediate section 34 and the upper intermediate section 36. Openings 42 through the lower intermediate section 34 align with openings 43 through the upper intermediate section 36 so these sections may be brought and pinned together.

Figure 7:
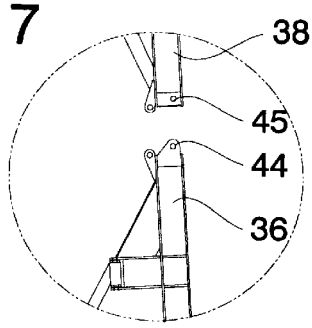

FIG. 7 illustrates an exploded view of the connection between the upper intermediate section 36 and the top section 38. Openings 44 through the upper intermediate section 36 align with openings 45 in the top section 38 so these sections may be brought and pinned together.

Sections of the mast will articulate as will be described herein. In one arrangement, the sub base 30 and the bottom section 32 will not articulate as will be described herein. The top section 38 will optionally articulate.

The teachings of the present invention will be illustrated through the articulation of the lower intermediate section 34 and the upper intermediate section 36 although it will be understood that the invention may be applied in various configurations.

Figure 9:
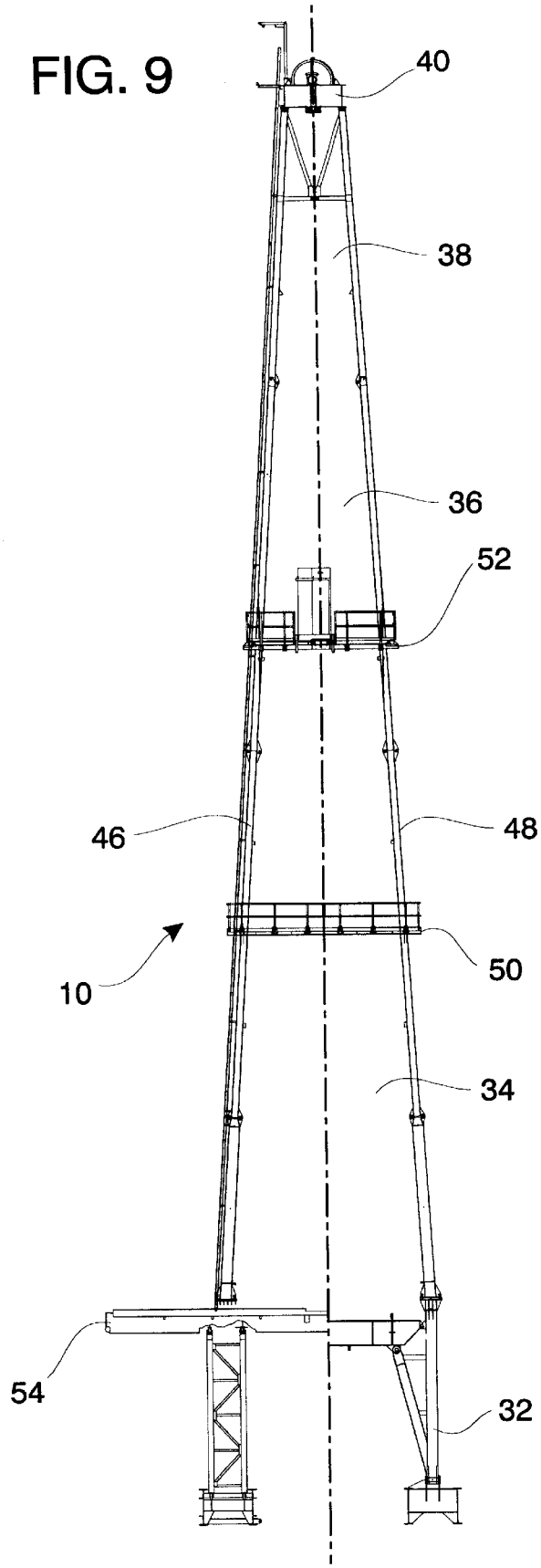
FIG. 9 shows a front view of an articulating mast constructed in accordance with the present invention with portions removed for clarity.

FIG. 9 illustrates an articulating mast 10 viewed looking into the front, open face. The mast 10 will include a pair of opposed sides 46 and 48. The mast 10 will also include a back face (not seen in FIG. 9) connecting the sides 46 and 48 together.

Across the front face may be a tubing support assembly 50 and a racking platform assembly 52 to assist in handling of the tubing sections (not shown). The bottom section 32 may include a drilling substructure floor 54 on which certain operations will be performed.

In one preferred embodiment, the mast 10 will include four legs. The legs, including legs 46 and 48 visible in FIG. 9, will be pyramidal in structure with the widest cross section at the sub base and tapering toward a more narrow portion at the crown assembly 40.

Figure 10:
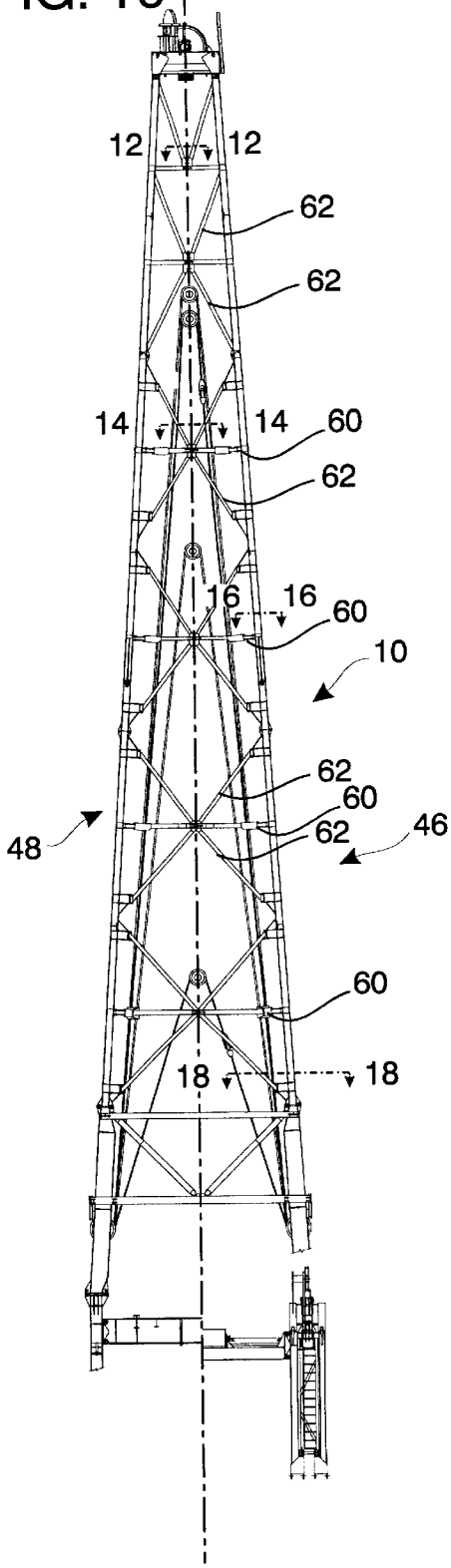
FIG. 10 shows a back view of an articulating mast as shown in FIG. 9 constructed in accordance with the present invention.
Figure 11:
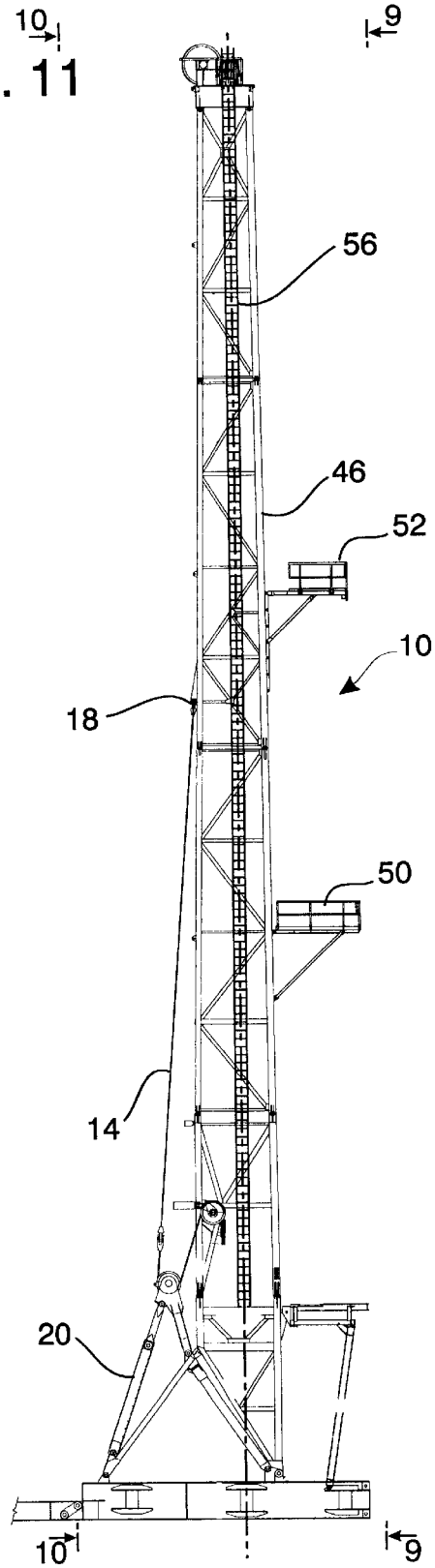
FIG. 11 shows a side view of an articulating mast as shown in FIG. 9 constructed in accordance with the present invention.

FIG. 10 illustrates a back view of the mast while FIG. 11 illustrates a side view of the mast shown in FIG. 9. A ladder 55 may be provided along one of the sides.

As will be described in detail herein, in order to fold for storage and transportation, the back face will articulate while the sides 46 and 48 remain rigid.

Returning to a consideration of FIG. 10, the back face includes a plurality of pairs of back face cross supports 60. Each pair of back face cross supports 60 together spans the back face and connects with the opposed sides and, in particular, connects the legs 56 and 58 of the sides 46 and 48.

Additionally, the back face includes a plurality of angled braces 62 extending between the cross supports 60 and the legs 56 and 58.

Figure 12:
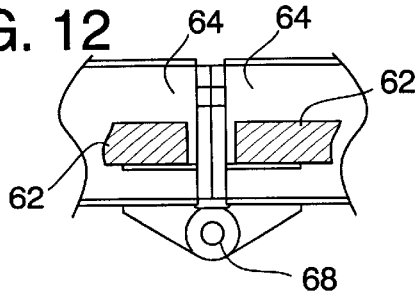
FIGS. 12 through 15 illustrate movement of back face cross supports of the articulating mast of the present invention.
Figure 13:
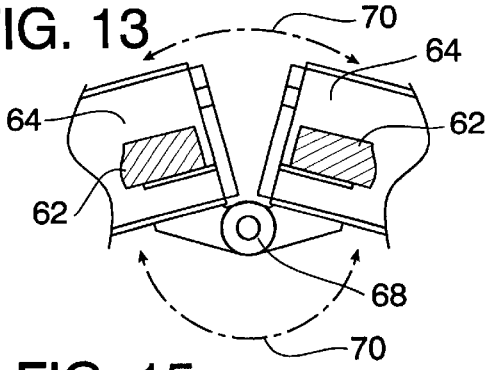
Figure 14:
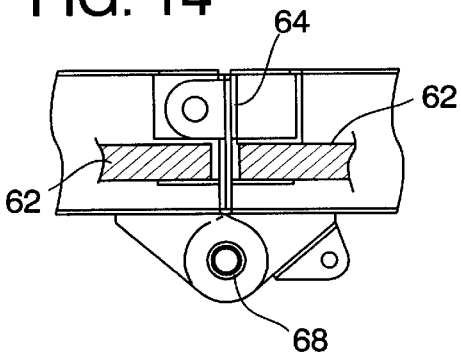
Figure 15:
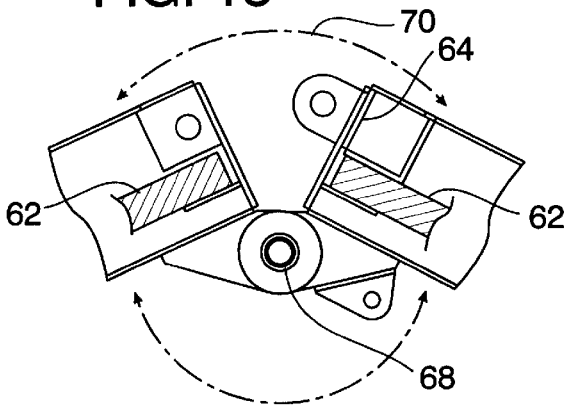

The articulation of the cross supports 60 may be observed from FIGS. 12, 13, 14 and 15. One pair of cross supports 60 is seen in FIGS. 12 and 13. FIG. 12 is a cross-sectional view taken along section line 12—12 of FIG. 10. Each individual cross support 60 has a first end and a second, opposed end 64. Each of the second ends 64 in the pair are pivotally connected to each other through a bushing 68. The bushing 68 may be a misaligning bushing having a ball inside of a race to accommodate two axes of movement. The cross supports 60 will rotate with respect to each other through one axis through the bushing 68. Additionally, since the sides 46 and 48 are tapered, a further rotation in the bushing will be accommodated. Arrows 70 in FIGS. 13 and 15 illustrate the movement.

FIGS. 12 and 13 show one pair of cross supports while FIGS. 14 and 15 show another pair of cross supports.

An angled brace 62 extends from and is rigidly connected to each cross support 60.

Figure 16:
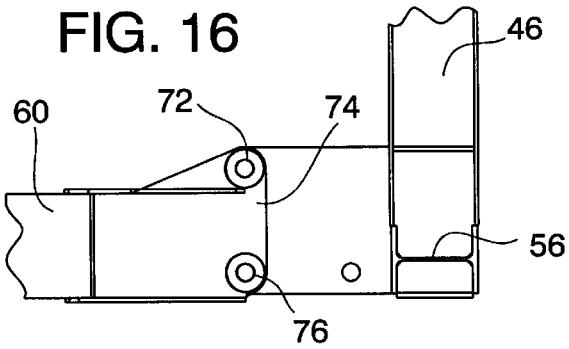
FIGS. 16, 17 and 18 illustrate movement of angled braces of the articulating mast constructed in accordance with the present invention.
Figure 17:
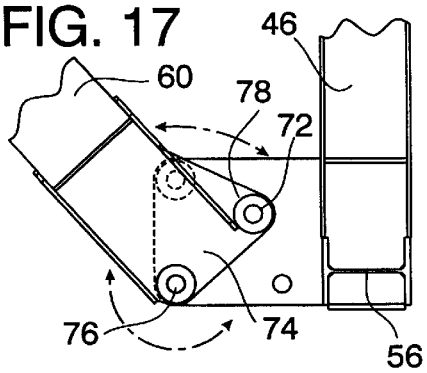

FIGS. 16 and 17 illustrate the pivotal connection between the cross supports 60 and the legs. Each cross support 60 will have a first end 74 which is pivotally connected to one of the legs 56 and side 46. First end 74 rotates about an axis about a hinge pin 76. Each first end 74 terminates in an extending ear 78 having an aperture 72 therethrough. As the first end 74 rotates, the extending ear will move between a storage position and an open position. The aperture 72 will align with an opening in the open position and will align with another opening in the storage position.

Figure 18:
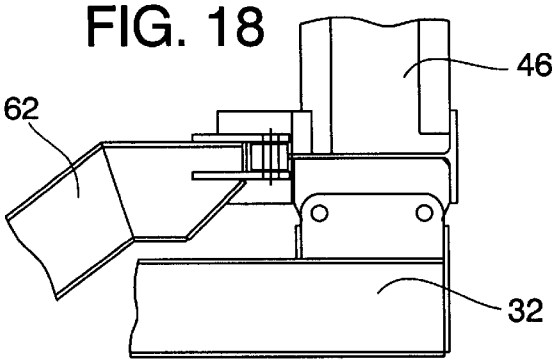

FIG. 18 illustrates a cross sectional view taken along section line 18—18 of FIG. 10 of the connection between the angled braces and the legs. The angled brace 62 will articulate with respect to the leg 46. The connection between the lower intermediate section and the bottom section is also visible.

Figure 19:
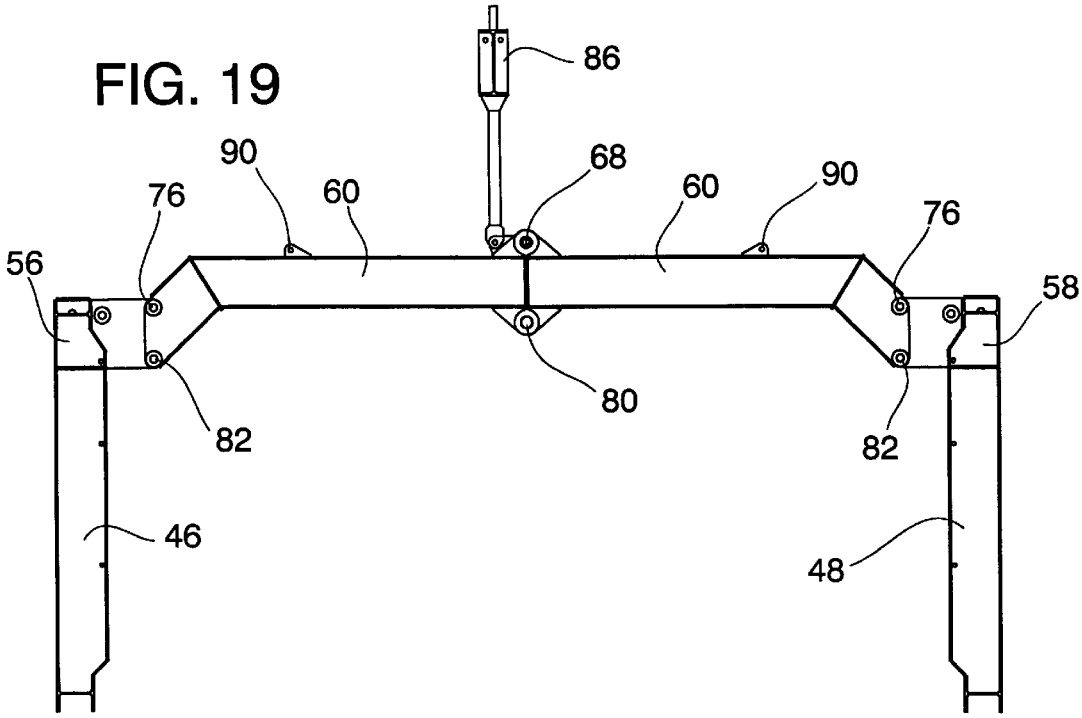
FIGS. 19, 20 and 21 illustrate movement of the back face of the articulating mast between an open in-use position and the folded, storage and transportation position.
Figure 20:
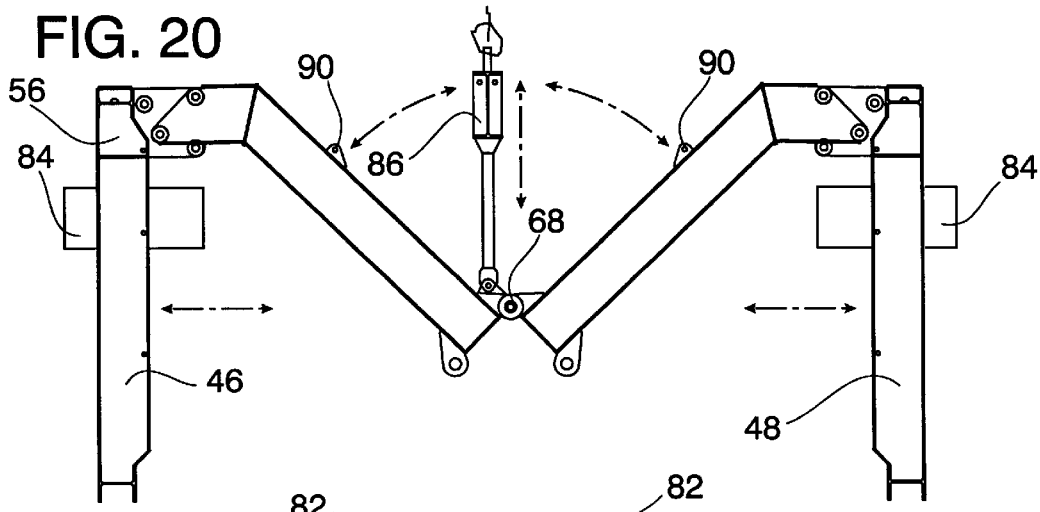
Figure 21:
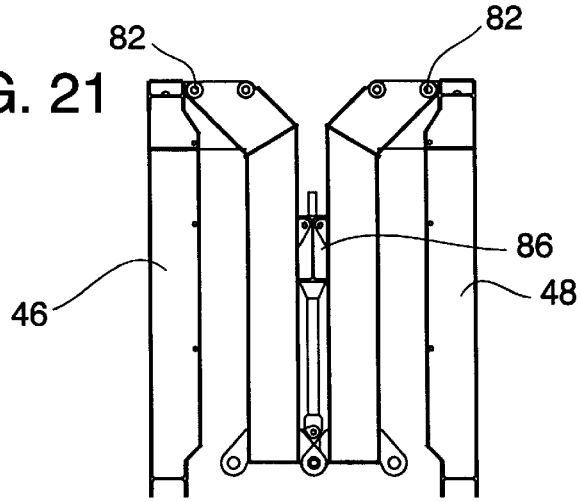

FIGS. 19, 20 and 21 show diagrammatic views of the movement of the lower intermediate section 34 or upper intermediate section 36 between the folded, storage and transportation position and the open, in-use position.

FIG. 19 shows the section in the fully opened position. The second end 64 of each cross support 60 rotates and articulates about a bushing 68. Likewise, each of the first ends 74 of the cross supports 60 rotates about a hinge pin 76. A lock pin 80 at the second ends locks the cross supports 60 to each other. The cross supports 60 are, thus, in linear alignment with each other.

Likewise, a pair of lock pins 82 passing through apertures in the extending ears 78 lock the cross supports to the sides 46 and 48.

When the pins 80 and 82 are removed, the cross supports will rotate about the bushing and the hinges. As seen in FIG. 20, the cross supports 60 are halfway between the open position and the storage position. The sides 46 and 48 may be moved toward each other by a forklift or crane or other force and may utilize pockets 84 attached to the sides 46 and 48.

FIG. 21 illustrates the fully folded position for storage and transportation. A lifting beam 86 and spreader bar or bars 88 may be utilized. One end of each spreader bar 88 will be attached between the cross supports near the bushing 68.

The extending ears 78 from the first ends of the cross supports 60 will align with openings near the legs. Pins through the aperture and openings will lock the sides and cross supports together. Additionally, the cross supports may have extending ears 90 which lock to the lifting bars or lock to each other.

Figure 22:
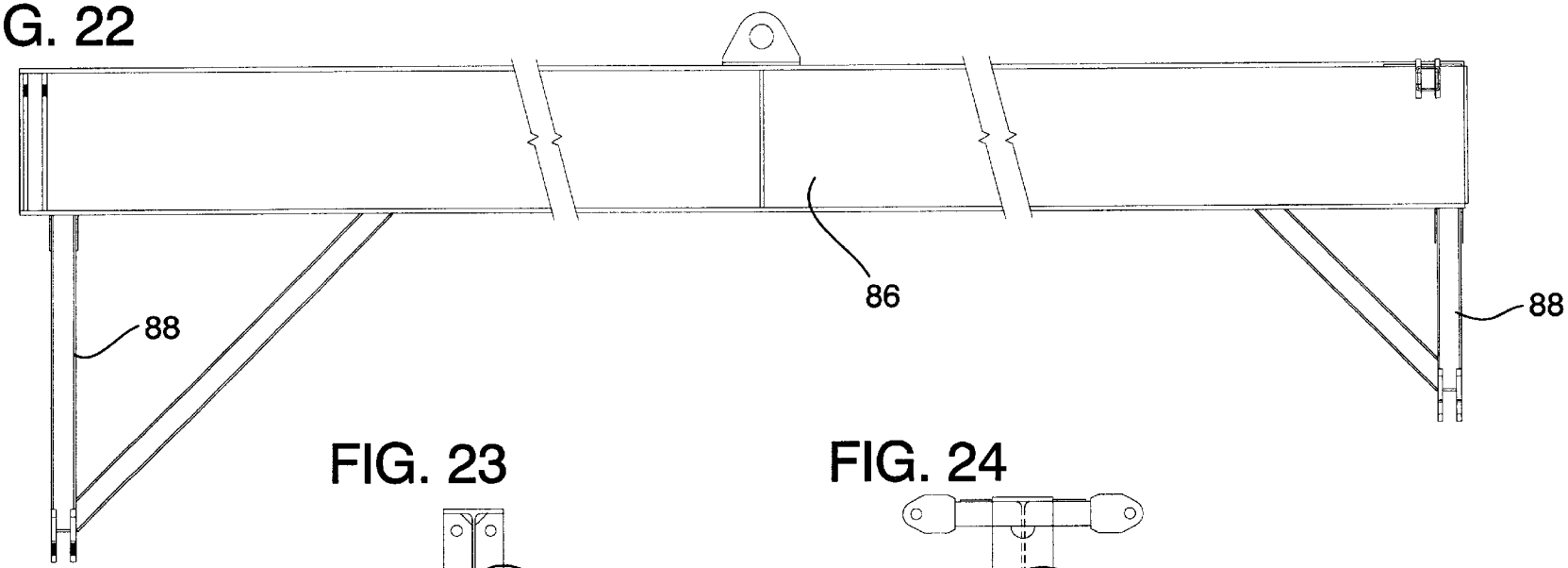
FIGS. 22, 23 and 24 illustrate a lifting beam and spreader bars of the articulating mast of the present invention.
Figure 24:
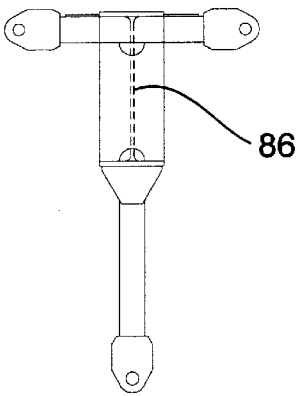
Figure 23:
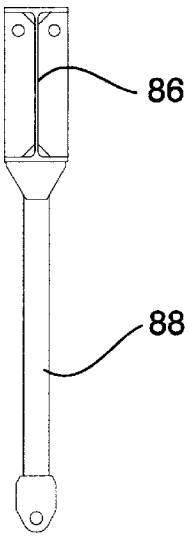

FIG. 22 shows the lifting beam 86 while FIGS. 23 and 24 show the accompanying spreader bars apart from the mast. The lifting beam 86 and spreader bars 88 will be removed once the mast 10 is in the opened position and ready for movement to the vertical, in-use position.

Figure 25:
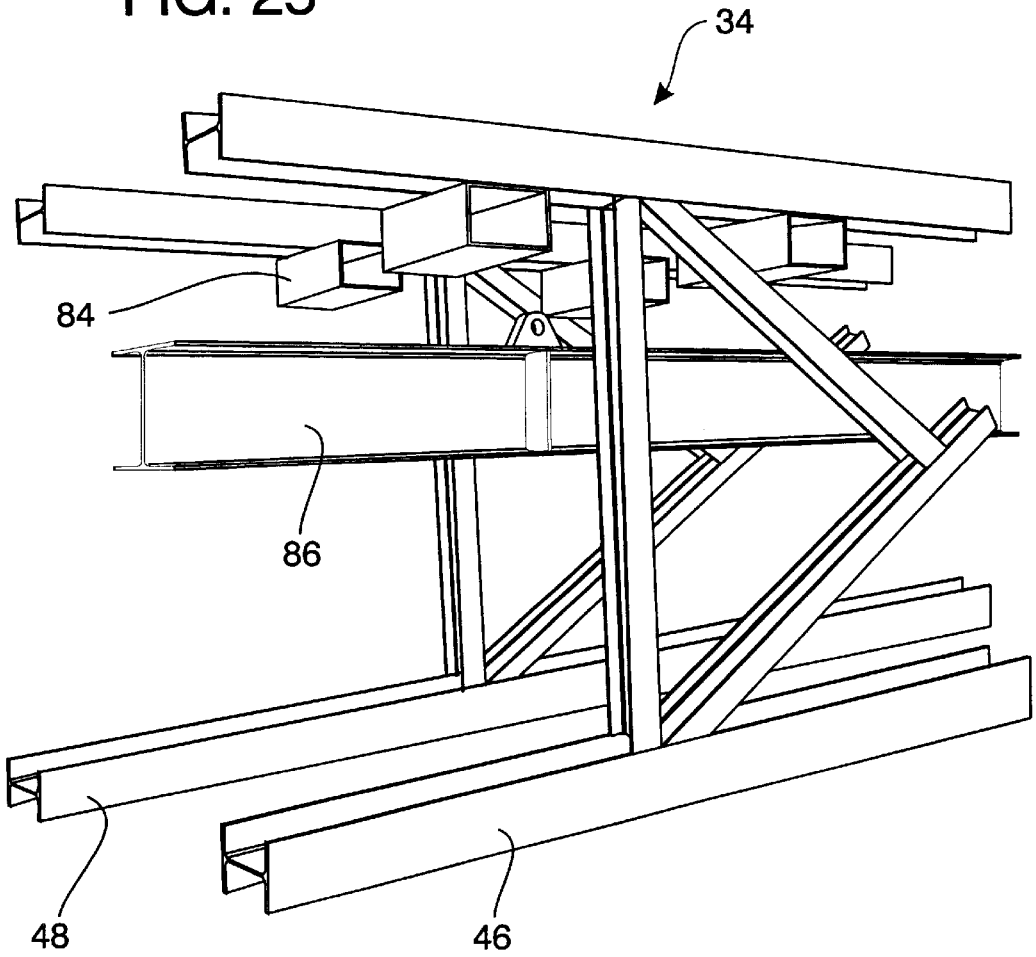
FIG. 25 illustrates a perspective view of the articulating mast constructed in accordance with the present invention in the folded, storage position.

FIG. 25 shows a perspective view of one section of a mast 10 in the completely folded position. The mast section is locked in place and ready for transportation. As seen in FIG. 22, a wire line may be attached to lift and move the entire section. In one preferred embodiment, the folded section is no more than twelve feet wide.

Accordingly, the invention reduces the disassembly required when moving a mast.

Whereas, the present invention has been described in relation to the drawings attached hereto, it should be understood that other and further modifications, apart from those shown or suggested herein, may be made within the spirit and scope of this invention.

What is claimed is:

1. An articulating derrick having a back face, a pair of opposed sides, each side having at least one leg, and an open face, which derrick comprises:

said back face extending between said legs and having a plurality of pairs of back face cross supports, each said cross support having a first and second opposed end, each said first end pivotally attached to one said leg; and a bushing to pivotally connect said second ends for each said pair of cross supports to permit movement of said back face between a storage position and an open position.

2. The articulating derrick as set forth in claim 1 including a lifting beam attached to said back face cross supports to move said back face from said storage position to said open position.

3. The articulating derrick as set forth in claim 2 wherein said lifting beam includes a spreader bar pivotally attached to said cross supports near said second ends.

4. The articulating derrick as set forth in claim 2 wherein said lifting beam includes an eye or eyes for connecting a wire line thereto.

5. The articulating derrick as set forth in claim 1 wherein said bushing is a misaligning bushing.

6. The articulating derrick as set forth in claim 1 wherein each said cross support first end includes a hinge pin connecting said leg and said cross support and wherein said first end terminates in an extending ear which moves between a storage position and an opened position.

7. The articulating derrick as set forth in claim 6 wherein each said extending ear includes an opening which will align with an opening in said open position or an opening in said closed position.

8. The articulating derrick as set forth in claim 1 wherein each said opposed side includes at least one pocket to receive a forklift for moving said side from said open to said closed position.

9. The articulating derrick as set forth in claim 1 including a plurality of angled braces which extend between each said leg and said cross supports.

10. The articulating derrick as set forth in claim 1 wherein each said angled brace is pivotally connected to said leg.

11. A method to fold an articulating derrick having a back face, a pair of opposed sides, each side having at least one leg, and an open face, which method comprises:

moving said derrick from a vertical to a horizontal position with said back face upward; and moving said pair of opposed sides toward each other while folding said back face.

12. A method to fold an articulating derrick as set forth in claim 11 wherein said back face includes a plurality of pairs of back face cross supports, each said cross support having a first and second opposed end, wherein each said first end is pivotally attached to one said leg and said second ends for each pair of cross supports are pivotally connected.

13. A method to unfold an articulating derrick having a back face, a pair of opposed sides, each side having at least one leg, and an open face, which method comprises:

moving said pair of opposed sides away from each other while unfolding said back face; and moving said derrick from a horizontal position to a vertical position.

* * * * *